US005222646A

United States Patent [19]

Mukoyama

[11] Patent Number: 5,222,646

[45] Date of Patent: Jun. 29, 1993

[54] NAILING MACHINE

[75] Inventor: Kenzi Mukoyama, Anjo, Japan

[73] Assignee: Makita Electric Works, Ltd., Anjo, Japan

[21] Appl. No.: 908,800

[22] Filed: Jul. 7, 1992

Related U.S. Application Data

[63] Continuation of Ser. No. 639,144, Jan. 8, 1991, abandoned.

[30] Foreign Application Priority Data

Jan. 12, 1990 [JP] Japan ..... 2-5677

[51] Int. Cl.[5] ..... B25C 1/00

[52] U.S. Cl. ..... 227/066; 227/148

[58] Field of Search ..... 227/148, 66, 110

[56] References Cited

U.S. PATENT DOCUMENTS

| | | | |
|---|---|---|---|
| 2,910,698 | 11/1959 | Paxton | 227/148 X |
| 2,994,878 | 8/1961 | Abrahamsen | 227/148 X |
| 3,112,488 | 12/1963 | Dettloff et al. | 227/148 |
| 3,147,484 | 9/1964 | Nelson | 227/148 X |
| 3,281,046 | 10/1966 | Boulay | 227/148 |
| 3,360,176 | 12/1967 | Gehl et al. | 227/148 |
| 3,597,142 | 8/1971 | Jasper | 227/148 X |
| 3,693,863 | 9/1972 | Black | 227/148 X |
| 4,196,833 | 4/1980 | Haytayan | 227/148 X |
| 4,907,730 | 3/1990 | Dion | 227/148 X |

*Primary Examiner*—Frank T. Yost
*Assistant Examiner*—Rinaldi Rada
*Attorney, Agent, or Firm*—Dennison, Meserole, Pollack & Scheiner

[57] ABSTRACT

A nailing machine includes a body, a nose extending from the body and having a nail guide channel therein, a driver reciprocally movable within the nail guide channel for driving the nail, and at least one first surface and at least one second surface formed on the end portion of the nose. The first surface extends perpendicular to the longitudinal axis of the nail guide channel. The second surface is formed in continuity with the first surface and is inclined at a predetermined angle with respect to the first surface.

7 Claims, 4 Drawing Sheets

NAILING MACHINE

This is a continuation of copending application Ser. No. 07/639,144 filed on Jan. 8, 1991, now abandoned.

BACKGROUND OF THE INVENTION

1. Field of the Invention

This invention relates to a nailing machine, and more particularly to a nailing machine which can be used for oblique nailing operation.

2. Description of the Prior Art

Japanese Utility Model Publication No. 53-24690 discloses a nailing machine having an inclined surface formed on the bottom end of a nose. The inclined surface extends upwardly from the peripheral portion of the outlet of a nail guide channel formed within the nose.

The construction of this prior art may prevent insufficient or excessive driving of a nail into a work to some extent. However, when the driving amount of a nailing driver is so determined that the whole of the nail including its head is completely driven into the work in the oblique operation, the nail may be excessively driven into the work in the normal nailing operation. Such excessive driving may not cause a serious problem if the work is a thick material. However, in the case of nailing into works such as backing materials of a wall or a floor which are thin materials, excessive driving of the nail may cause degradation of yield strength of the construction of the wall or the floor.

SUMMARY OF THE INVENTION

It is, accordingly, an object of the present invention to provide a nailing machine which can obliquely and perpendicularly drive a nail into a work without insufficient or excessive driving with a uniform driving amount.

According to the present invention, there is provided a nailing machine comprising a body, a nose extending from the body and having a nail guide channel therein, a driver reciprocally movable within the nail guide channel for driving the nail, and at least one first surface and at least one second surface formed on the end portion of the nose. The first surface extends perpendicular to the longitudinal axis of the nail guide channel. The second surface is formed in continuity with the first surface and is inclined at a predetermined angle with respect to the first surface.

The second surface is inclined with respect to the first surface about an axis which extends tangentially from the nail guide channel in a plane perpendicular to the longitudinal axis of the nail guide channel.

The end portion of the nose may include a pair of the second surfaces disposed on both sides of the nail guide channel.

The invention will become more fully apparent from the claims and the description as it proceeds in connection with the drawings.

DETAILED DESCRIPTION OF THE PREFERRED EMBODIMENT

Figure 1:
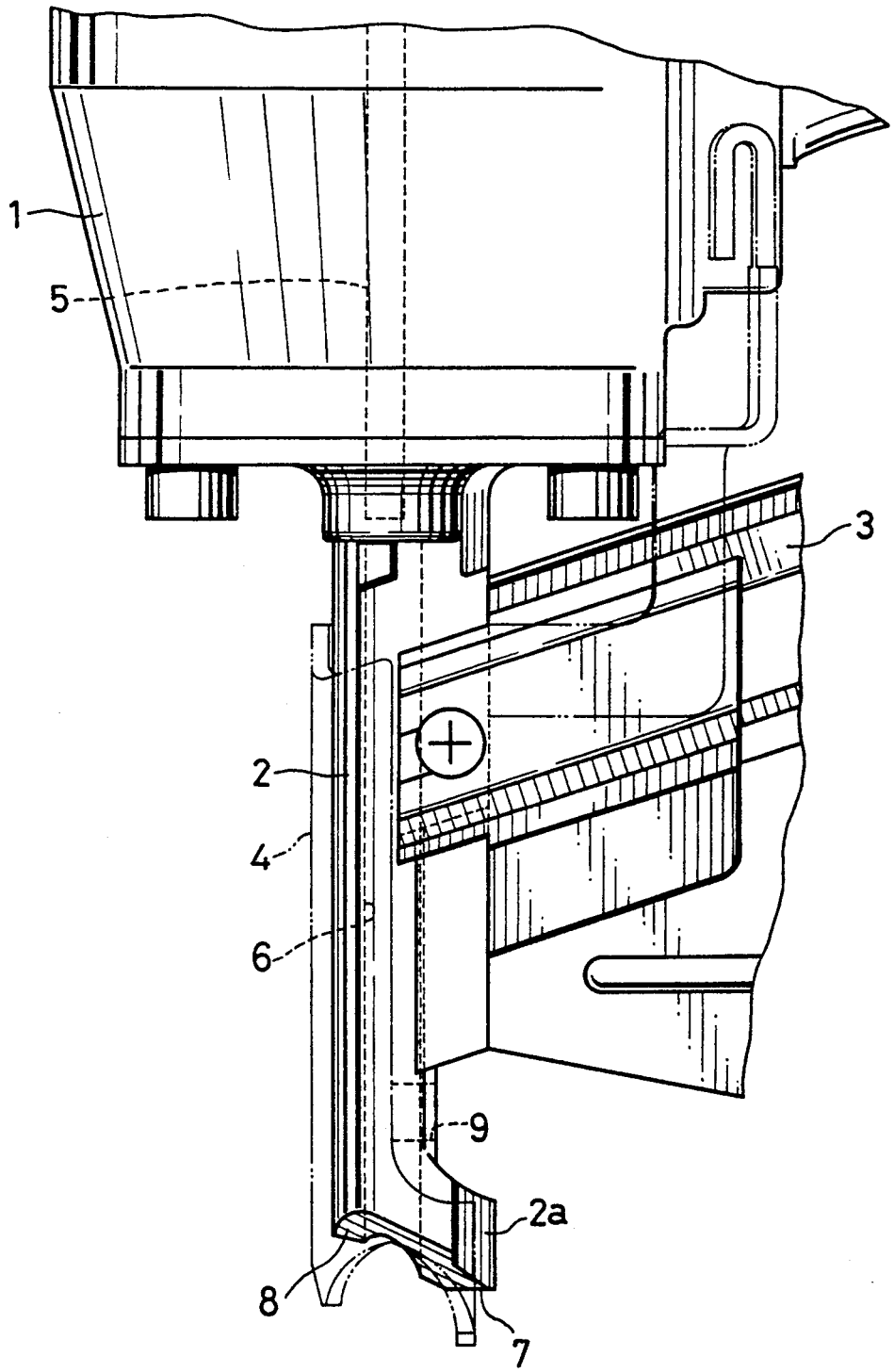
FIG. 1 is a front view of a part of a nailing machine according to an embodiment of the present invention.
Figure 2:
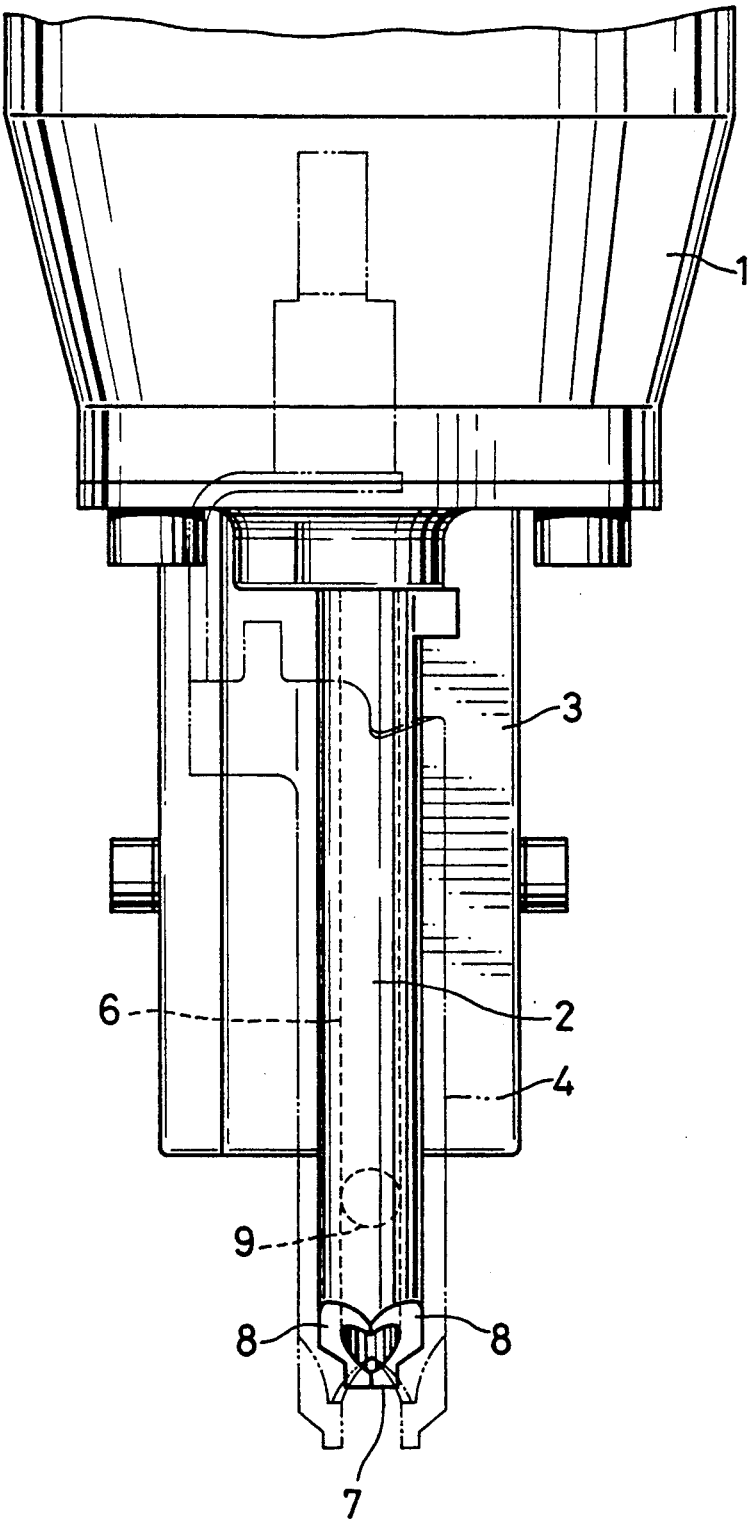
FIG. 2 is a left side view of FIG. 1.

Referring to FIGS. 1 and 2, there is shown a part of a nailing machine having a body 1. A nose 2 is mounted on one end of the body 1 for nailing operation. A magazine 3 accommodating a plurality of nails is obliquely mounted on the central portion of the nose 2 in a longitudinal direction. A contact arm 4 is slidably disposed along the nose 2 in the longitudinal direction. The contact arm 4 permits nailing operation by pulling a trigger (not shown) when it is moved to an upper position.

The outer profile of the nose 2 is substantially rectangular in section having one curved side. The bottom end of the nose 2 includes a protruded portion 2*a* which extends laterally on the side of the magazine 3. The nose 2 includes a nail guide channel 6 which is circular in section and extends throughout the nose in the longitudinal direction. A driver 5 extends from the body 1 into the nail guide channel 6 and is driven to reciprocally move into the nail guide so as to push the nail.

Figure 3:
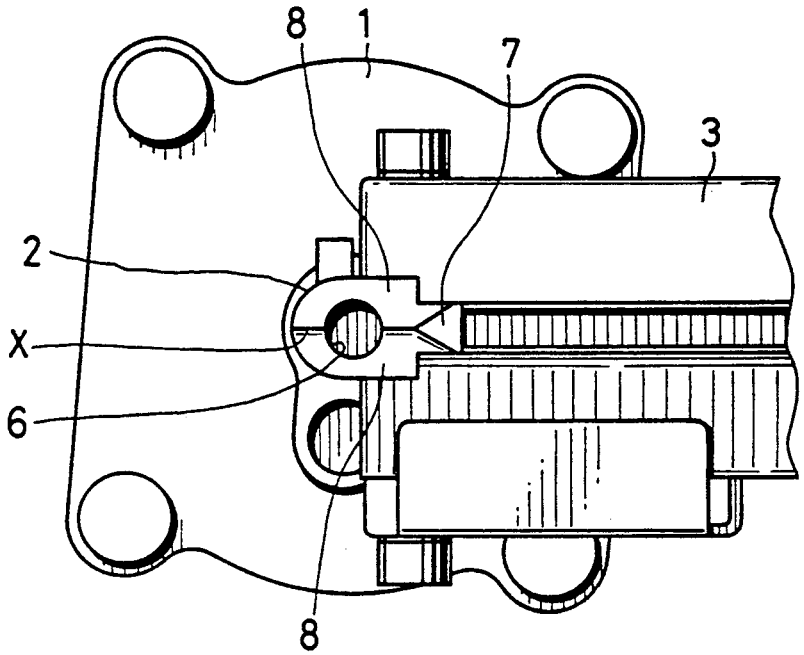
FIG. 3 is a bottom view of FIG. 1.
Figure 4:
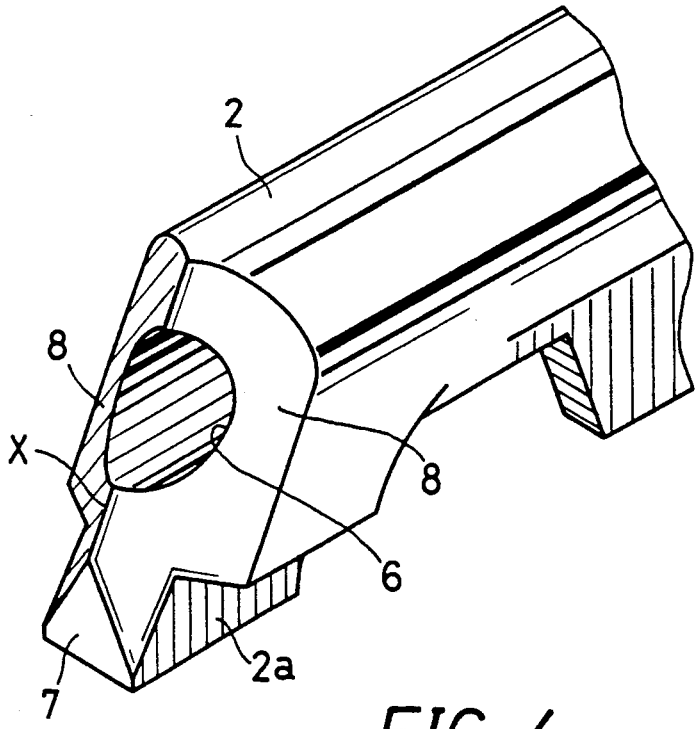
FIG. 4 is an enlarged perspective view of the bottom portion of a nose shown in FIG. 1.

As shown in FIGS. 3 and 4, the bottom portion of the nose 2 includes a first surface 7 which is perpendicular to the longitudinal axis of the nail guide channel 6, and second surfaces 8 which are formed in continuity with the first surface 7 and are disposed at both sides of the bottom portion. The second surfaces 8 are inclined to the first surface 7 as will be hereinafter explained.

Figure 5B:
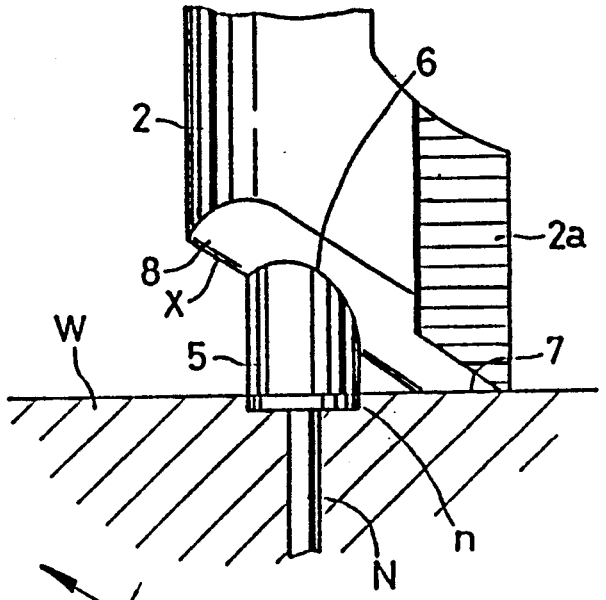
FIG. 5B is a schematic view of the nailing machine showing a nail driven into a work perpendicular thereto.
Figure 5A:
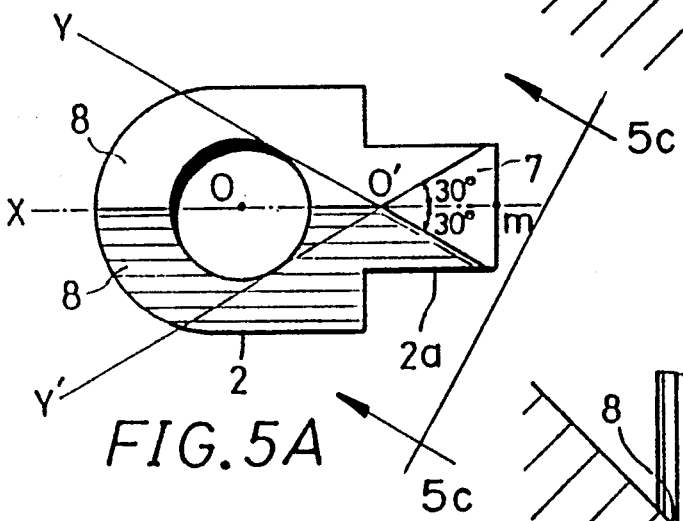
FIG. 5A is an enlarged bottom view of the nose.

In FIG. 5A, lines Y, Y' are drawn on the same surface as the first surface 7. The lines Y, Y' are inclined to a central line X at an angle of 30° at the opposite sides thereof, respectively. The central line X goes through the center O of the nail guide channel 6 as well as the center of the protruded position 2*a*. A point m indicates a central point of one side of the protruded portion 2*a* opposite to the nail guide channel 6. The lines Y, Y' touch the periphery of the nail guide channel 6 so that they are tangential lines to the periphery. The lines Y, Y', intersect at a point O' on the central line X. The second surfaces 8 are inclined upwardly at an angle of 45° about the lines Y, Y', respectively, and intersect on the central line X to form a ridge line. The ridge line X is directed upward and toward the front side of the nose 2 or towards the left side is shown in FIG. 1. Thus, the first surface 7 is separated by lines Y, Y' from the second surfaces 8 and has a substantially triangular shape in which the point O' is one of the vertexes.

A circular opening 9 is formed within the nose 2 and connects the nail guide channel 6 with the outside. The opening 9 is disposed upwardly of the protruded portion 2*a* on the side of the mounting portion of the magazine 3. The diameter of the hole 9 is larger than that of the head portion of the nail to be used, so that the nail which has been choked in the nail guide channel 6 can be easily moved out.

The contact arm 4 is of substantially U-shaped configuration in section to conform to the outer profile of the nose 2. The bottom end of the contact arm 4 is also shaped to conform to the bottom portion of the nose 2 and thus to the first surface 7 and the second surfaces 8.

In operation, the nailing machine is placed so as to press the bottom portion of the nose 2 on a work. With such placement, the contact arm 4 is moved upward along the nose 2 by the abutment on the work. When the contact arm 4 has been moved upwardly for a predetermined distance, the driver 5 can be driven for the nailing operation by pulling the trigger.

In the case of nailing of a nail N perpendicular to the work W as shown in FIG. 5B, the body 1 is held by an operator to position the nose 2 perpendicular to the work W so as to press the first surface 7 on the work W.

The driving amount of the nail N into the work W is so determined that the nail N is driven fully into the work W and that an upper surface of a head n of the nail N is positioned in the same surface with the work W.

Figure 5C:
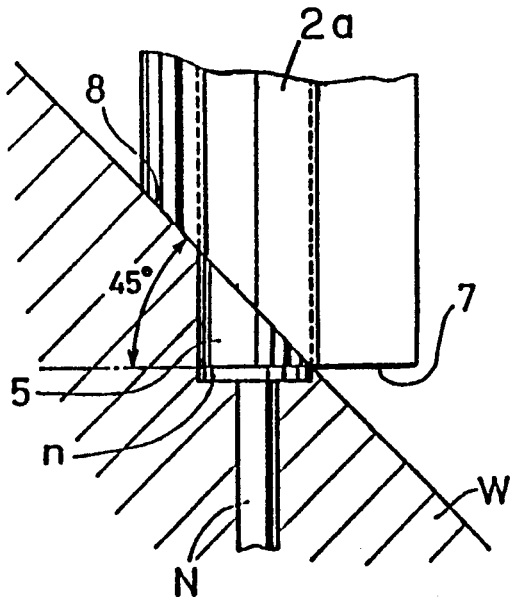
FIG. 5C is a view of FIG. 5A in the direction of arrows 5C of the nailing machine showing the nail obliquely driven into the work.

In the case of nailing obliquely to the work W as shown in FIG. 5C, the body 1 is held to position the nose 2 obliquely to the surface of the work W so as to press one of the second surfaces 8 on the work W. The amount of driving of the nail N in this case is the same as the above operation.

As described above, the surfaces 8 are inclined at an angle of 45° about the lines Y, Y' which are inclined at an angle of 30° with respect to the central line X of the nail guide channel 6, respectively, and the lines Y, Y' go through the periphery line of the nail guide channel 6. Therefore, the whole of the nail N is driven into the work W where the nail N is to be driven and the upper surface of the head n of the nail N is positioned in the same surface with the work W at this position.

Since the opening 9 formed in the nose 2 has a larger diameter than that of the head n of the nail N, the nail N can be easily taken out from the nail guide channel 6 if it has been choked in the nail guide channel 6.

Although in the above embodiment, the lines Y, Y' are inclined at an angle of 30°, and the second surfaces 8 are inclined at an angle of 45° about the lines Y, Y', such angles can be selectively determined according to the required inclination of the work W.

Further, although in the above embodiment, the bottom portion of the nose 2 includes two second surfaces 8 disposed on both sides of the ridge line which goes through the central line X, such second surfaces 8 may be formed on only one side of the bottom portion.

While the invention has been described with reference to a preferred embodiment, it is to be understood that modifications or variations may be easily made without departing from the spirit of this invention which is defined by the appended claims.

What is claimed is:

1. A nailing machine comprising:

a body;

a nose extending from said body and having a nail guide channel formed therein, said nail guide channel having a longitudinal axis and an opening at one end of said nose;

a driver reciprocally movable within said nail guide channel for driving a nail;

at least one first surface and at least one second surface formed on said one end of said nose, said first surface extending perpendicular to the longitudinal axis of said nail guide channel, said second surface being formed in continuity with said first surface and inclined at a predetermined angle with respect to said first surface, said opening of said nail guide channel being on said second surface, wherein said second surface is inclined with respect to said first surface about an axis which corresponds to a tangent to the opening of said nail guide channel, said tangent being in a plane substantially perpendicular to said longitudinal axis of said nail guide channel.

2. A nailing machine comprising:

a body;

a nose extending from said body having a longitudinal axis, a nail guide channel with an end portion and an opening;

a driver reciprocally movable within said nail guide channel for driving a nail;

at least one first surface and at least one second surface formed on the end portion of said nose, said first surface being perpendicular to a first longitudinal axis of said nail guide channel, said second surface being formed in continuity with said first surface and inclined at a predetermined angle with respect to said first surface and said nail guide channel, said opening being within said second surface, wherein said second surface is inclined with respect to said first surface about a second axis which extends as a tangent from said nail guide channel in a plane substantially perpendicular to said longitudinal axis.

3. A nailing machine comprising:

a body;

a nose extending from said body having a longitudinal axis, a nail guide channel with an end portion and an opening;

a driver reciprocally movable within said nail guide channel for driving a nail;

a plurality of surfaces formed on the end portion of said nose, said plurality of surfaces including a first surface being perpendicular to the longitudinal axis of said nail guide channel, a pair of second surfaces being formed in continuity with said first surface and inclined at predetermined angles with respect to said first surface and said nail guide channel, said opening being entirely within said inclined second surfaces.

4. A nailing machine as defined in claim 3 wherein said pair of second surfaces are inclined relative to said first surface around second axes Y and Y' which are positioned within a plane substantially perpendicular to the longitudinal axis of said nail guide channel, respectively.

5. The nailing machine as defined in claim 4 wherein said pair of second surfaces are disposed on both sides of the opening of said nail guide channel in a symmetrical manner.

6. The nailing machine as defined in claim 5 wherein said pair of second surfaces form therebetween a ridge line which is inclined at a predetermined angle relative to said first surface and said ridge line extends along a line X through the center of the opening of said nail guide channel.

7. The nailing machine as defined in claim 5 wherein said second axes Y and Y' intersect each other at a point O' on the line X through the center of said opening in a plane substantially perpendicular to said longitudinal axis of said nail guide channel, the inclination angles of said second axis Y, Y' relative to said line X are equal, and the inclination angles of said pair of second surfaces relative to said axes Y, Y' are 45°.

* * * * *